US010698332B2

(12) United States Patent
Fukuda et al.

(10) Patent No.: US 10,698,332 B2
(45) Date of Patent: Jun. 30, 2020

(54) IMAGE FORMING APPARATUS

(71) Applicant: CANON KABUSHIKI KAISHA, Tokyo (JP)

(72) Inventors: Tadashi Fukuda, Tokyo (JP); Takahito Fuse, Nagareyama (JP); Masami Hano, Abiko (JP); Shota Soda, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/536,338

(22) Filed: Aug. 9, 2019

(65) Prior Publication Data

US 2020/0057401 A1 Feb. 20, 2020

(30) Foreign Application Priority Data

Aug. 20, 2018 (JP) ..... 2018-154294

(51) Int. Cl.
*G03G 15/02* (2006.01)
*G03G 21/20* (2006.01)

(52) U.S. Cl.
CPC ..... *G03G 15/0258* (2013.01); *G03G 21/203* (2013.01)

(58) Field of Classification Search
CPC ..... G03G 15/02; G03G 15/0208; G03G 15/0216; G03G 15/0225; G03G 15/0233; G03G 15/0258; G03G 2215/02; G03G 2215/021; G03G 2215/025; G03G 2221/1693
See application file for complete search history.

(56) References Cited

U.S. PATENT DOCUMENTS

2014/0064758 A1* 3/2014 Kitajima ..... G03G 15/0283 399/50
2017/0090326 A1* 3/2017 Yamaguchi ..... G03G 15/0216

FOREIGN PATENT DOCUMENTS

JP 2007334148 A * 12/2007
JP 2015118346 A * 6/2015
JP 2017-062440 A 3/2017

* cited by examiner

*Primary Examiner* — Thomas S Giampaolo, II
(74) *Attorney, Agent, or Firm* — Venable LLP

(57) ABSTRACT

An image forming apparatus includes a photosensitive member, a first charging roller, a first cleaning member, a second charging roller, and a second cleaning member. The following relationship is satisfied:

$$(X \times L0 + L1 + L2) - (Y \times L3 + L4) \neq 0$$

where L0 represents a length of a whole circumference of the first charging roller, L1 represents a length between a first contact area and a first contact position of the first charging roller and the photosensitive member, L3 represents a length of a whole circumference of the second charging roller, L4 represents a length between a second contact area and a second contact position, L2 represents a length between the first contact position and the second contact position, X represents an integer in a range of $0 \leq X \leq 40$, and Y represents an integer in a range of $0 \leq Y \leq 40$.

11 Claims, 9 Drawing Sheets

IMAGE FORMING APPARATUS

BACKGROUND OF THE INVENTION

Field of the Invention

The present invention relates to an image forming apparatus that forms an image on a recording material by using an electrophotographic system or an electrostatic recording system.

Description of the Related Art

Conventionally, a contact charging system to perform primary charging has been widely used in image forming apparatuses with the electrophotographic system. In the contact charging system, a charging roller is used, and the charging roller includes a conductive supporting member (core metal), a conductive elastic layer formed on the outer circumferential surface of the conductive supporting member, and a resistive layer formed on the outer circumferential surface of the conductive elastic layer. When the charging roller is applied with a voltage, slight electric discharge occurs in the vicinity of an abutment nip portion that is a contact area between the charging roller and the photosensitive drum, so that the surface of the photosensitive drum is charged with electricity.

However, as electrophotographic devices are more improved in image quality, speed, and service life, the charging capability of the single charging roller of the contact charging system becomes insufficient. As a result, image defects, such as unevenness in charging, will easily occur. For this reason, Japanese Patent Application Publication No. 2017-62440 proposes a charging apparatus including a plurality of charging rollers for speeding up the charging process. Specifically, the charging apparatus includes an upstream charging roller and a downstream charging roller. In addition, for increasing the service life of the charging rollers, the charging rollers are provided with a cleaning member (cleaning roller). The cleaning roller has an elastic layer, which is disposed in contact with the charging rollers for cleaning the charging rollers.

However, when the charging apparatus of Japanese Patent Application Publication No. 2017-62440 has not been used for a long time, and thus the charging rollers and the cleaning member have been in contact with each other for the long time, a component of the material of the charging rollers may chemically react with a component of the material of the cleaning member. Through this chemical reaction, a contact portion of each charging roller that has been in contact with the cleaning member may be contaminated. When the contact portion of the charging roller, which has been in contact with the cleaning member, contacts the photosensitive drum in the next image formation, the contact portion of the charging roller may cause an image defect such as uneven density. In particular, since the charging apparatus of Japanese Patent Application Publication No. 2017-62440 has the plurality of charging rollers located upstream and downstream in a rotational direction of the photosensitive drum, each of the charging rollers may cause the image defect. If the image defect caused by the contaminated portion of the upstream charging roller and the image defect caused by the contaminated portion of the downstream charging roller overlap with each other on the photosensitive drum, the overlapping image defects may become conspicuous, even though each of the image defects is inconspicuous.

SUMMARY OF THE INVENTION

An object of the present invention is to provide an image forming apparatus that includes a plurality of charging rollers, and that prevents image defects caused by the charging rollers and respective cleaning members that have been in contact with each other when not operated.

According to a first aspect of the present invention, an image forming apparatus includes a photosensitive member configured to move while bearing an electrostatic latent image, a first charging roller configured to be rotated by being in contact with the photosensitive member and charge the photosensitive member in a case where a charging bias is applied, a first cleaning member in contact with the first charging roller at a first contact area and configured to clean a surface of the first charging roller, a second charging roller configured to be rotated by being in contact with the photosensitive member and charge the photosensitive member in a case where a charging bias is applied, the second charging roller being in contact with the photosensitive member at a second contact position positioned downstream, in a moving direction of the photosensitive member, from a first contact position at which the first charging roller is in contact with the photosensitive member, and a second cleaning member in contact with the second charging roller at a second contact area and configured to clean a surface of the second charging roller. The following first relationship is satisfied $$(X \times L0 + L1 + L2) - (Y \times L3 + L4) \neq 0$$

where L0 represents a length of a whole circumference of the first charging roller, L1 represents a length in a circumferential direction of the first charging roller between a center position of the first contact area in the circumferential direction and the first contact position of the first charging roller and the photosensitive member, L3 represents a length of a whole circumference of the second charging roller, L4 represents a length in a circumferential direction of the second charging roller between a center position of the second contact area in the circumferential direction and the second contact position of the second charging roller and the photosensitive member, L2 represents a length in the moving direction of the photosensitive member between the first contact position and the second contact position, X represents an integer in a range of $0 \leq X \leq 40$, and Y represents an integer in a range of $0 \leq Y \leq 40$. The first relationship is satisfied in all combinations of X and Y.

According to a second aspect of the present invention, an image forming apparatus includes a photosensitive member configured to move while bearing an electrostatic latent image, a first charging roller configured to be rotated by being in contact with the photosensitive member and charge the photosensitive member in a case where a charging bias is applied, a second charging roller configured to be rotated by being in contact with the photosensitive member and charge the photosensitive member in a case where a charging bias is applied, the second charging roller being in contact with the photosensitive member at a second contact position positioned downstream, in a moving direction of the photosensitive member, from a first contact position at which the first charging roller is in contact with the photosensitive member, and a cleaning member in contact with the first charging roller at a first contact area, in contact with the second charging roller at a second contact area, and configured to clean a surface of the first and second charging rollers. The following third relationship is satisfied $$(X \times L0 + L1 + L2) - (Y \times L3 + L4) \neq 0$$

where L0 represents a length of a whole circumference of the first charging roller, L1 represents a length in a circumferential direction of the first charging roller between a center position of the first contact area in the circumferential direction and the first contact position of the first charging roller and the photosensitive member, L3 represents a length of a whole circumference of the second charging roller, L4 represents a length in a circumferential direction of the second charging roller between a center position of the second contact area in the circumferential direction and the second contact position of the second charging roller and the photosensitive member, L2 represents a length in the moving direction of the photosensitive member between the first contact position and the second contact position, X represents an integer in a range of $0 \leq X \leq 40$, and Y represents an integer in a range of $0 \leq Y \leq 40$. The third relationship is satisfied in all combinations of X and Y.

Further features of the present invention will become apparent from the following description of exemplary embodiments with reference to the attached drawings.

DESCRIPTION OF THE EMBODIMENTS

First Embodiment

Hereinafter, a first embodiment of the present invention will be described in detail with reference to FIGS. 1 to 7. In the present embodiment, an image forming apparatus 1 is a tandem-type full-color printer, as one example. However, the present invention may be applied not only to the tandem-type image forming apparatus 1, but also to other-type image forming apparatuses. In addition, the present invention may be applied not only to full-color printers, but also to monochrome or monocolor printers. Furthermore, the present invention may be implemented in various products, including printers, printing machines, copying machines, facsimile machines, and multifunction printers.

Figure 1:
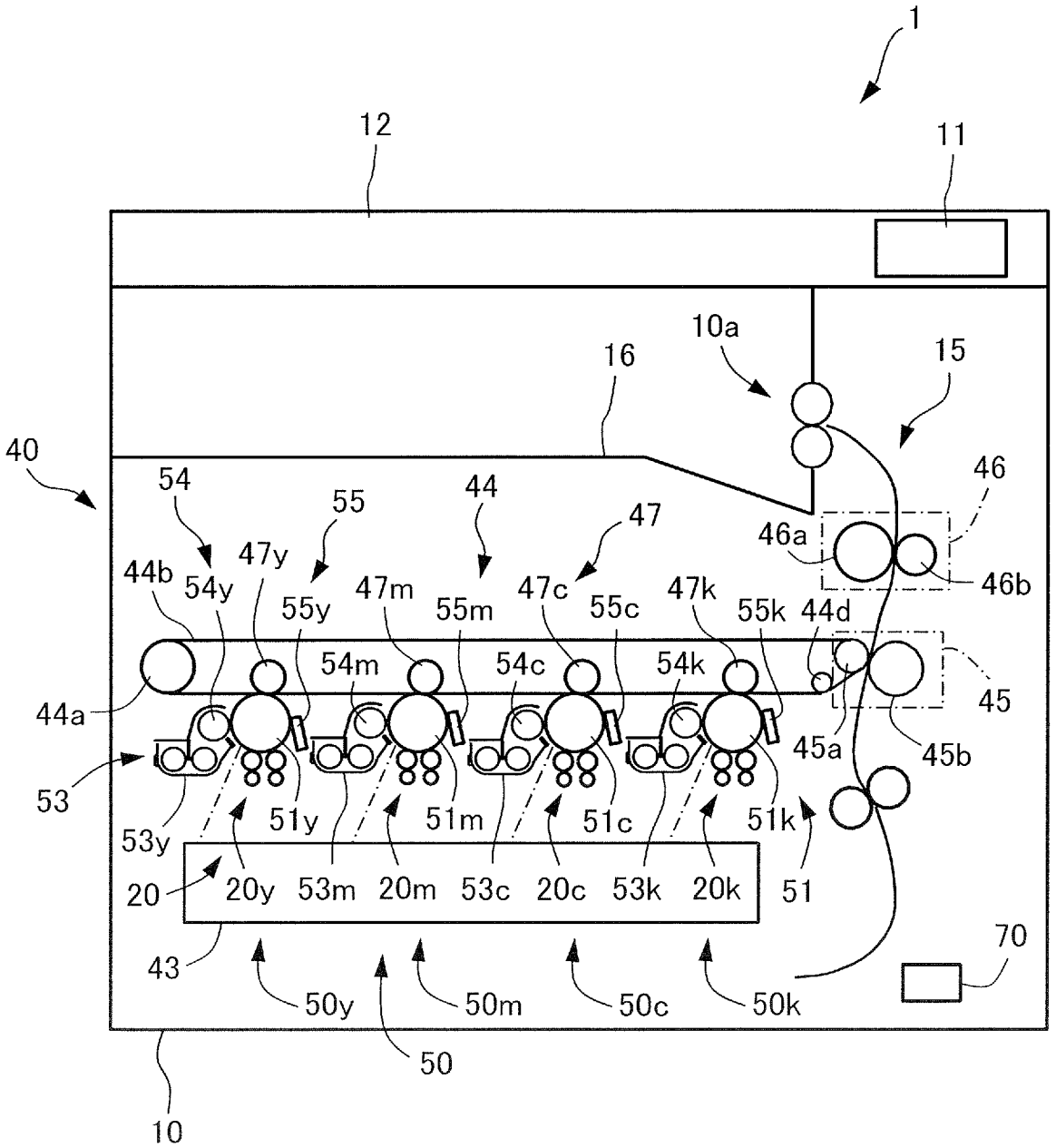
FIG. 1 is a cross-sectional view schematically illustrating a configuration of an image forming apparatus of a first embodiment.

As illustrated in FIG. 1, the image forming apparatus 1 includes an apparatus body 10, a sheet feeding portion (not illustrated), an image forming portion 40, a sheet conveyance portion 15, a control unit 70, and an operation unit 11. The image forming apparatus 1 forms a full-color (four-color) image on a recording material in accordance with an image signal from a document reader 12, a host device, such as a personal computer, or an external device, such as a digital camera or a smart phone. The recording material is a sheet on which a toner image is to be formed, and may be a plain-paper sheet, a synthetic-resin sheet used instead of the plain-paper sheet, a thick-paper sheet, or an overhead-projector sheet.

Image Forming Portion

The image forming portion 40 forms an image on a sheet fed from the sheet feeding portion, in accordance with image information. The image forming portion 40 includes image forming units 50*y*, 50*m*, 50*c*, and 50*k*, toner bottles (not illustrated), an exposure apparatus 43, an intermediate transfer unit 44, a secondary transfer portion 45, and a fixing apparatus 46. The image forming apparatus 1 of the present embodiment forms a full-color image, and thus the image forming units 50*y*, 50*m*, 50*c*, and 50*k* respectively form yellow (y), magenta (m), cyan (c), and black (k) images. The image forming units 50*y*, 50*m*, 50*c*, and 50*k* have the same configuration, and are separated from each other. Thus, in FIG. 1, a component corresponding to one of the four colors is indicated by a symbol and an identifier, which follows the symbol and indicates the color. But in FIGS. 3 to 9 and in the specification, the component corresponding to one of the four colors may be indicated by a symbol alone.

The image forming units 50*y*, 50*m*, 50*c*, and 50*k* respectively include photosensitive drums (photosensitive members) 51*y*, 51*m*, 51*c*, and 51*k* that rotate while carrying electrostatic latent images, charging portions 20*y*, 20*m*, 20*c*, and 20*k*, and developing apparatuses 53*y*, 53*m*, 53*c*, and 53*k*. The image forming unit 50 is a unitized process cartridge, and is detachably attached to the apparatus body 10 to form a toner image on a later-described intermediate transfer belt 44*b*.

The photosensitive drum 51 moves, or rotates, while carrying an electrostatic latent image or a toner image used to form an image. In the present embodiment, the photosensitive drum 51 is an organic photoreceptor (OPC) having an outer diameter of 30 mm and negatively charged. The photosensitive drum 51 is rotated at a predetermined process speed (circumferential velocity) in a rotational direction R (see FIG. 3), by a driving motor (driving source) 13 (see FIG. 2). The charging portion 20 negatively and uniformly charges the surface of the photosensitive drum 51 by applying a negative direct-current voltage to the surface of the photosensitive drum 51. The exposure apparatus 43 is a laser scanner, and emits a laser beam in accordance with the image information on separated color. The image information is output from the control unit 70.

The developing apparatuses 53*y*, 53*m*, 53*c*, and 53*k* respectively include developing sleeves 54*y*, 54*m*, 54*c*, and 54*k*. When a developing bias is applied to the developing apparatus 53, the developing apparatus 53 develops an electrostatic latent image, formed on the photosensitive drum 51, into a toner image by using toner. The developing apparatus 53 contains toner supplied from a toner bottle, and develops an electrostatic latent image formed on the photosensitive drum 51. The developing sleeve 54 may be made of aluminum or nonmagnetic material such as nonmagnetic stainless steel. In the present embodiment, the developing sleeve 54 is made of aluminum. Inside the developing sleeve 54, a magnet roller is fixed so as not to rotate with respect to a developing container. The developing sleeve 54 carries developer that contains nonmagnetic toner and magnetic carrier, and conveys the developer to a developing area that faces the photosensitive drum 51.

In the present embodiment, the developer is a two-component developer that contains nonmagnetic toner and magnetic carrier. A toner particle has a body including binding resin and coloring agent, and additive added to the body. In the present embodiment, the resin of the toner particle is polyester resin that can be negatively charged, and the toner particles have a volume average particle diameter of 7 μm. The carrier may be made of metal, alloy, or ferrite oxide. The metal may be iron, nickel, cobalt, manganese, chromium, or rare-earth metal (the surface of these metals may or may not be oxidized); and the alloy may be made by using the above-described examples of the metal. In the present embodiment, the carrier is ferrite carrier, whose particles have a volume average particle diameter of 40 μm and which has a resistivity of $10^8\Omega$ cm.

The toner image developed on the surface of the photosensitive drum 51 is primary-transferred in the later-described intermediate transfer unit 44. The image forming units 50*y*, 50*m*, 50*c*, and 50*k* respectively include cleaning blades 55*y*, 55*m*, 55*c*, and 55*k*. The cleaning blade 55 is a counterblade, and is pressed against the photosensitive drum 51 with a predetermined pressing force. After the primary transfer, the toner not transferred in the intermediate transfer unit 44 and left on the photosensitive drum 51 is removed by the cleaning blade 55, pressed against the photosensitive drum 51, for the next image forming process.

The intermediate transfer unit 44 includes a plurality of rollers and an intermediate transfer belt 44*b*. The plurality of rollers include a driving roller 44*a*, a driven roller 44*d*, and primary transfer rollers 47*y*, 47*m*, 47*c*, and 47*k*. The intermediate transfer belt 44*b* is wound around the plurality of rollers, and moves while carrying toner images. The driven roller 44*d* is a tension roller to keep a constant tension of the intermediate transfer belt 44*b*. The driven roller 44*d* is applied with urging force by an urging spring (not illustrated), and pushes the intermediate transfer belt 44*b* toward the front-surface side of the intermediate transfer belt 44*b*. The primary transfer rollers 47*y*, 47*m*, 47*c*, and 47*k* respectively face the photosensitive drums 51*y*, 51*m*, 51*c*, and 51*k*; and abut against the intermediate transfer belt 44*b* to primary-transfer toner images formed on the photosensitive drum 51, onto the intermediate transfer belt 44*b*.

The intermediate transfer belt 44*b*, which abuts against the photosensitive drum 51, and the photosensitive drum 51 form a primary transfer portion. When applied with a primary transfer bias, the primary transfer portion primary-transfers a toner image formed on the photosensitive drum 51, onto the intermediate transfer belt 44*b*. Specifically, when the intermediate transfer belt 44*b* is applied with a positive primary transfer bias by the primary transfer roller 47, toner images formed on the photosensitive drums 51*y*, 51*m*, 51*c*, and 51*k* and having negative polarity are sequentially transferred onto the intermediate transfer belt 44*b* such that one toner image is transferred onto another toner image on the intermediate transfer belt 44*b*.

The secondary transfer portion 45 includes a secondary transfer inner roller 45*a* and a secondary transfer outer roller 45*b*. The secondary transfer outer roller 45*b* abuts against the intermediate transfer belt 44*b*, and a nip portion is formed between the secondary transfer outer roller 45*b* and the intermediate transfer belt 44*b*. In the nip portion, a secondary transfer bias with a polarity opposite to the toner's polarity is applied from the secondary transfer outer roller 45 to the intermediate transfer belt 44*b*. Thus, the secondary transfer outer roller 45*b* secondary-transfers the toner images, formed on the intermediate transfer belt 44*b*, onto a sheet supplied into the nip portion.

The fixing apparatus 46 includes a fixing belt 46*a* and a pressure roller 46*b*. When the sheet is sandwiched between the fixing belt 46*a* and the pressure roller 46*b*, and conveyed by the fixing belt 46*a* and the pressure roller 46*b* in the sheet conveyance direction, the toner image formed on the sheet is heated and pressurized, so that the toner image is fixed to the sheet. The sheet conveyance portion 15 conveys the sheet fed from the sheet feeding portion, to the image forming portion 40; and discharges the sheet from an outlet 10*a* onto a discharging tray 16.

Figure 2:
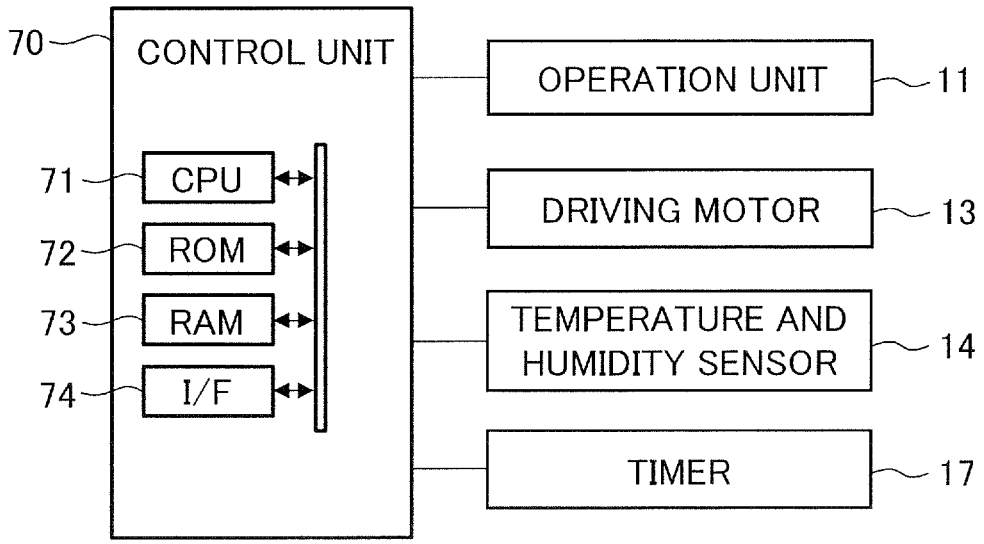
FIG. 2 is a block diagram illustrating a control system of the image forming apparatus of the first embodiment

As illustrated in FIG. 2, the control unit 70 is a computer, and may include a CPU 71, a ROM 72 that stores programs to control components, a RAM 73 that temporarily stores data, and an input/output (I/F) circuit 74 via which signals are sent to or received from an external device. The CPU 71 is a microprocessor to control the image forming apparatus 1, and serves as a main component of a system controller. The ROM 72 stores setting values necessary to control each component, and is accessed by the CPU 71 when necessary. The RAM 73 temporarily stores a variety of data (such as the number of prints) that changes depending on image forming operation, and is used to control each component.

The CPU 71 is connected, via the input/output circuit 74, to an operation unit 11, a driving motor 13, a temperature-and-humidity sensor (environment detection unit) 14, and a timer (time detection unit) 17. The control unit 70 performs setting in accordance with an instruction from a computer (not illustrated) connected to the apparatus body 10, or with an instruction from a user operating the operation unit 11.

The temperature-and-humidity sensor 14 is disposed in the apparatus body 10 to detect the temperature, the humidity, and the amount of moisture of the interior of the apparatus body 10. Thus, the CPU 71 controls the driving motor 13 in accordance with the operation of the operation unit 11, or with the detection result by the temperature-and-humidity sensor 14. The timer 17 detects a time for which images are formed, and a time for which no images are formed. In addition, the timer 17 also detects a time for which the charging rollers 21 and 22 have not been operated. Thus, the CPU 71 can detect a non-operation time for which the later-described charging rollers, 21 and 22, and the cleaning rollers, 31 and 32, have been in contact with each other without forming any image.

Image Forming Operation

Next, an image forming operation of the image forming apparatus 1 configured in this manner will be described. When the image forming operation is started, the photosensitive drum 51 rotates, and the surface of the photosensitive drum 51 is charged by the charging portion 20. Then the photosensitive drum 51 is irradiated with a laser beam emitted from the exposure apparatus 43 in accordance with image information, and an electrostatic latent image is formed on the surface of the photosensitive drum 51. Then the toner adheres to the electrostatic latent image, and the electrostatic latent image is developed and visualized as a toner image. The toner image is then transferred onto the intermediate transfer belt 44*b*.

In synchronization with such a toner-image forming operation, a sheet is supplied. Specifically, at a timing at which the toner image is transferred onto the intermediate transfer belt 44*b*, the sheet is conveyed to the secondary transfer portion 45 through the conveyance path. Then the toner image is transferred from the intermediate transfer belt 44*b* onto the sheet, and the sheet is conveyed to the fixing apparatus 46. In the fixing apparatus 46, the unfixed-toner image is heated and pressurized so as to be fixed to the surface of the sheet, and the sheet is then discharged from the apparatus body 10.

Charging Portion

Figure 3:
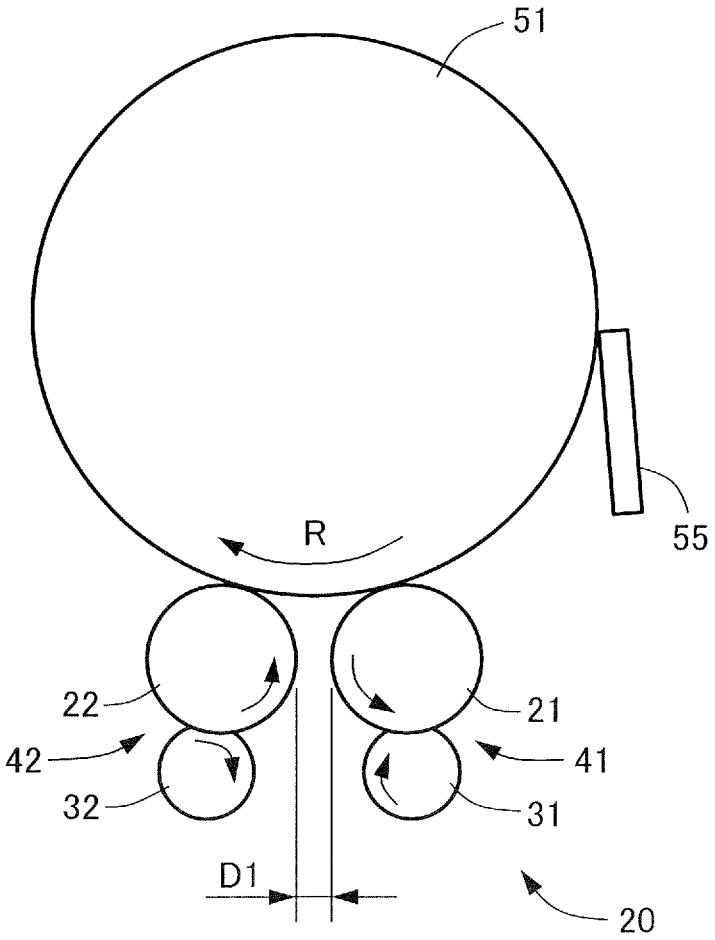
FIG. 3 is a side view schematically illustrating a photosensitive drum and a charging portion of the image forming apparatus of the first embodiment.

Next, a configuration of the charging portion 20 will be described in detail. As illustrated in FIG. 3, the charging portion 20 includes a first charging roller 21 and a second charging roller 22. The first charging roller 21 is disposed upstream in a rotational direction (moving direction) R of the photosensitive drum 51, and the second charging roller 22 is disposed downstream in the rotational direction R. The charging rollers 21 and 22 are in contact with the photosensitive drum 51 and rotate, depending on the rotation of the photosensitive drum 51, for negatively and uniformly charging the surface of the photosensitive drum 51. The charging portion 20 further includes a first cleaning roller (first cleaning member) 31 corresponding to the first charging roller 21, and a second cleaning roller (second cleaning member) 32 corresponding to the second charging roller 22. The first cleaning roller 31 is in contact with the first charging roller 21 and rotates depending on the rotation of the first charging roller 21, while cleaning the first charging roller 21. The second cleaning roller 32 is in contact with the second charging roller 22 and rotates depending on the rotation of the second charging roller 22, while cleaning the second charging roller 22.

The first cleaning roller 31 is urged toward the first charging roller 21 by an urging spring (not illustrated). The total pressure by the urging spring is 350 gf, for example. Since the urging spring urges the first cleaning roller 31, the first cleaning roller 31 and the first charging roller 21 are in contact with each other, and deformed by a predetermined amount. Here, an area in which the first charging roller 21 is in contact with the first cleaning roller 31 is a first contact area 41. When the first cleaning roller 31 rotates depending on the rotation of the first charging roller 21 in a state where the first charging roller 21 is pressed by the first cleaning roller 31 at the total pressure of 350 gf, the difference in circumferential velocity between the first charging roller 21 and the first cleaning roller 31 is within 5%. The same holds true for the second charging roller 22 and the second cleaning roller 32. An area in which the second charging roller 22 is in contact with the second cleaning roller 32 is a second contact area 42.

Thus, the first charging roller 21 rotates in contact with the photosensitive drum 51, and charges the photosensitive drum 51 when applied with a charging bias. The second charging roller 22 is in contact with the photosensitive drum 51 at a first contact position positioned downstream, in the rotational direction R of the photosensitive drum 51, from a second contact position at which the first charging roller 21 is in contact with the photosensitive drum 51. The second charging roller 22 also rotates in contact with the photosensitive drum 51, and charges the photosensitive drum 51 when applied with a charging bias. The first cleaning roller 31 contacts the first contact area 41 of the first charging roller 21, and cleans the surface of the first charging roller 21. The second cleaning roller 32 contacts the second contact area 42 of the second charging roller 22, and cleans the surface of the second charging roller 22.

Charging Bias

In the present embodiment, the charging method of the charging rollers is an AC-and-DC charging method. In this method, a direct-current voltage is added with an alternate-current voltage, and the resulting voltage is applied to the charging rollers. For achieving uniformity of the charging, the alternate-current voltage has a peak-to-peak voltage Vpp more than two times the direct-current voltage obtained when the charging is started. However, only the direct-current voltage may be applied in accordance with a charge potential required to charge the photosensitive drum 51. In the present embodiment, a direct-current voltage V1 added with an alternate-current voltage V2 is applied to the charging rollers 21 and 22. For example, a bias voltage, −700 V added with 1300 Vpp, is applied to the first charging roller 21 and the second charging roller 22.

A power supply used is a high-voltage power supply that can produce a direct-current voltage in a range from −500 to −1000 V, and an alternate-current voltage in a range from 700 to 2200 Vpp, in accordance with an environment where the image forming apparatus 1 is installed, and with the condition of the charging rollers 21 and 22 and the photosensitive drum 51. In the present embodiment, the charging rollers 21 and 22 share the direct-current voltage and the alternate-current voltage, which are applied to the charging rollers 21 and 22. Thus, the plurality of charging rollers 21 and 22 can be applied with a voltage by a shared high-voltage power supply. Here, the above-described values of the direct-current voltage and the alternate-current voltage are merely examples, and thus may be changed as appropriate in accordance with the property of the photosensitive drum 51 to be charged.

A shortest distance D1 between the first charging roller 21 and the second charging roller 22 may be set in accordance with a voltage applied to the first charging roller 21 and the second charging roller 22. Preferably, the shortest distance D1 is 3 mm or more. In the present embodiment, the shortest distance D1 is 4.5 mm in accordance with the above-described voltage applied to the first charging roller 21 and the second charging roller 22.

Charging Roller

Figure 4A:
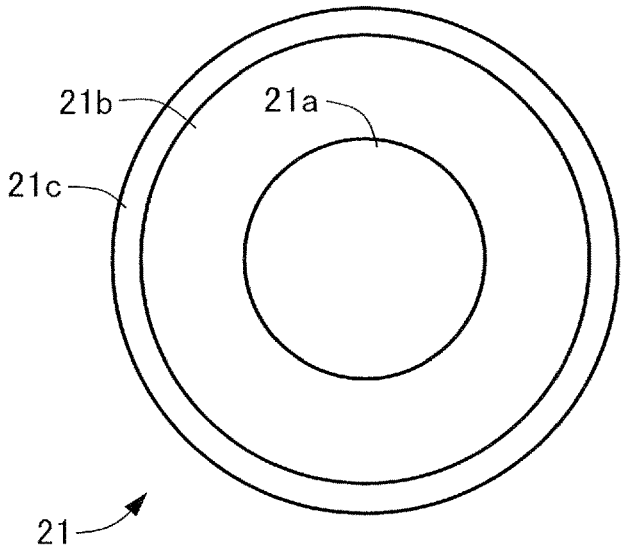
FIG. 4A is a side view of a first charging roller of the charging portion of the image forming apparatus of the first embodiment.

A configuration of the charging rollers 21 and 22 of the present embodiment will be described with reference to FIG. 4A. Since the configuration of the first charging roller 21 is the same as that of the second charging roller 22, the configuration of the first charging roller 21 will be described herein, and the description for the configuration of the second charging roller 22 will be omitted. The first charging roller 21 includes a supporting member 21*a*, an elastic layer 21*b*, and a surface layer 21*c*. The elastic layer 21*b* is formed on the outer circumferential surface of the supporting member 21*a*, and the surface layer 21*c* is formed on the elastic layer 21*b*. The supporting member 21*a* may be a shaft having good wear resistance and bending stress. In the present embodiment, the supporting member 21*a* is a shaft whose surface layer is plated with nickel. The supporting member has an outer diameter of 8 mm, and is made of stainless steel (SUS). The elastic layer 21*b* may be rubber, which has conventionally been used for an elastic layer of a charging member, or thermoplastic elastomer. In the present embodiment, the elastic layer 21*b* is made of epichlorohydrin rubber; the surface layer 21*c* is made of acrylic polymer that contains fluorine; and the outer diameter of the charging roller is 14 mm. The surface hardness of the charging roller can be measured by using ASKER durometer type C. In the present embodiment, the surface hardness of the charging roller is in a range of 60 to 80.

The material of the elastic layer 21*b* may be a rubber composition or thermoplastic elastomer. The rubber composition has a base rubber that may be polyurethane, silicone rubber, butadiene rubber, isoprene rubber, chloroprene rubber, or styrene-butadiene rubber. In other cases, the material of the elastic layer 21*b* may be a rubber composition or thermoplastic elastomer. The rubber composition has a base rubber that may be ethylene-propylene rubber, polynorbornene rubber, styrene-butadiene-styrene rubber, or epichlorohydrin rubber. When the thermoplastic elastomer is used, the thermoplastic elastomer is not limited to a specific type of thermoplastic elastomer. For example, the thermoplastic elastomer may be one or more types of thermoplastic elastomer, selected from the general-purpose styrene elastomer and olefinic elastomer. In addition, for achieving necessary elastic force, solid rubber or foamed rubber may be used.

The elastic layer 21*b* may be given predetermined conductivity by adding conducting material to the elastic layer 21*b*. The conducting material is not limited to a specific material. For example, the conducting material may be a material in which cationic surfactant, anionic surfactant, amphoteric surfactant, or antistatic agent has at least one group having active hydrogen that reacts with isocyanate, such as hydroxyl group, carboxyl group, or a primary or secondary amine group. The cationic surfactant includes quaternary ammonium salt such as perchlorate, chlorate, hydroborofluoride salt, ethosulfate salt, or benzyl halide salt, for example. The perchlorate includes perchlorate of lauryl trimethyl ammonium, stearyl trimethyl ammonium, octadodecyl trimethyl ammonium, dodecyl trimethyl ammonium, hexadecyl trimethyl ammonium, or denatured fatty acid and dimethylethyl ammonium, for example. The benzyl halide salt includes benzyl halide salt of benzyl bromide salt or benzyl halide salt, for example. The anionic surfactant includes aliphatic sulfonic acid, higher alcohol sulfate ester salt, sulfate salt added with higher alcohol ethylene oxide, higher alcohol phosphoric ester salt, or phosphate salt added with higher alcohol ethylene oxide, for example. The amphoteric surfactant includes various types of betaine, for example. The antistatic agent includes nonionic antistatic agent such as higher alcohol ethylene oxide, polyethylene glycol fatty acid ester, or polyhydric alcohol fatty acid ester, for example. Also the antistatic agent includes metallic salt of the first group of the periodic table (such as $Li^+$, $Na^+$, or $K^+$ of $LiCF_3SO_3$, $NaClO_4$, $LiAsF_6$, $LiBF_4$, NaSCN, KSCN, and NaCl and so on), electrolyte such as $NH^{4+}$, metallic salt of the second group of the periodic table (such as $Ca^{2+}$ or $Ba^{2+}$ of $Ca(ClO_4)^2$ and so on), or a combination thereof, for example.

In addition, the conducting material may be ion conducting material such as complex of polyhydric alcohol (such as 1,4-butanediol, ethylene glycol, polyethylene glycol, propylene glycol, or polyethylene glycol) and its derivative, ion conducting material such as complex of monool (such as ethylene glycol monomethyl ether or ethylene glycol monoethyl ether) and its derivative, conductive carbon such as ketjenblack EC or acetylene black, carbon for rubber such as SAF, ISAF, HAF, FEF, GPF, SRF, FT, or MT, oxidized carbon for (color) ink, pyrolytic carbon, natural graphite, artificial graphite, metal or metal oxide such as antimony-doped tin oxide, titanium oxide, zinc oxide, nickel, copper, silver, or germanium, or conductive polymer such as polyaniline, polypyrrole, or polyacetylene. The amount of the conducting material may be determined as appropriate in accordance with the composition of the elastic layer 21*b*. Typically, the amount of the conducting material is adjusted so that the volume resistivity of the elastic layer 21*b* is $10^2\Omega\cdot$cm to $10^8\Omega\cdot$cm, and preferably, adjusted so that the volume resistivity of the elastic layer 21*b* is $10^3\Omega\cdot$cm to $10^6\Omega\cdot$cm.

The surface layer 21*c* is made of polyester resin, acrylic resin, urethane resin, acrylic urethane resin, nylon resin, epoxy resin, polyvinyl acetal resin, vinylidene chloride resin, fluororesin, or silicone resin. The material of the surface layer 21*c* may be an organic resin or a water-based resin. In addition, the surface layer 21*c* may be given conductivity by adding conducting material to the surface layer 21*c*, or the conductivity of the surface layer 21*c* may be adjusted by adding conducting material to the surface layer 21*c*. The conducting material is not limited to a specific material. For example, the conducting material may be conductive carbon such as ketjenblack EC or acetylene black, carbon for rubber such as SAF, ISAF, HAF, FEF, GPF, SRF, FT, or MT, oxidized carbon for (color) ink, pyrolytic carbon, natural graphite, artificial graphite, or metal or metal oxide such as antimony-doped tin oxide, titanium oxide, zinc oxide, nickel, copper, silver, or germanium. When the above-described conducting material is used together with organic solvent, it is preferable that the surface treatment, such as the silane coupling treatment, is performed on the surface of particles of the conducting material for dispersiveness. The amount of the conducting material may be adjusted as appropriate for a desired resistance of the surface layer 21*c*. Since the charging is stable when the electrical resistance of the surface layer 21*c* becomes higher than that of the elastic layer 21*b*, the volume resistivity of the surface layer 21*c* is required to be in a range from $10^3\Omega\cdot$cm to $10^{15}\Omega\cdot$cm. Preferably, the volume resistivity of the surface layer 21*c* is in a range from $10^5\Omega\cdot$cm to $10^{14}\Omega\cdot$cm.

In addition, small and large particles of resin may be added to the surface layer 21*c*, which serves as an outermost conductive resin layer. The resin particles may be insulative acrylic particles (having a volume resistivity of $10^{10}\Omega\cdot$cm or more) other than the above-described conducting materials, or may be made of copolymer resin of acrylic resin and styrene resin. In this case, the resin particles added to the surface layer 21*c* is especially preferable because the resin particles hardly change the stiffness of the surface layer 21*c*. When the above-described inorganic filler is used in solvent-based paint, it is preferable that the hydrophobic surface treatment is performed on the surface of the filler particles so that the filler particles easily disperse in the paint. In addition, it is also preferable that organic particles having good compatibility with the resin material of the surface layer 21*c* are used, because the organic particles will hardly aggregate.

The method of making the first charging roller 21 is not limited to a specific method. Preferably, paint that contains necessary components is first prepared, and the paint is then applied to the first charging roller 21, by dipping or spraying, to form a film on the first charging roller 21. In this case, when a plurality layers are formed on the first charging roller 21 as outer layers, the dipping or the spraying may be repeated to form each layer on the first charging roller 21 by using a corresponding paint. For forming the outer layer, the dipping or the spraying is preferably used.

Cleaning Roller

Figure 4B:
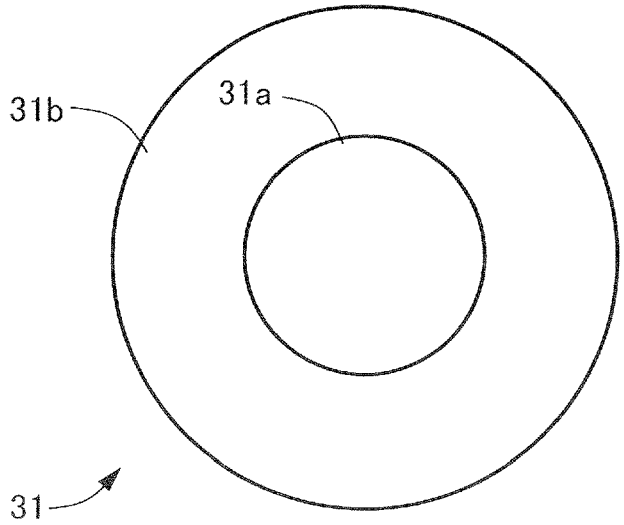
FIG. 4B is a side view of a first cleaning roller of the charging portion of the image forming apparatus of the first embodiment.

A configuration of the cleaning rollers 31 and 32 of the present embodiment will be described with reference to FIG. 4B. Since the configuration of the first cleaning roller 31 is the same as that of the second cleaning roller 32, the configuration of the first cleaning roller 31 will be described herein, and the description for the configuration of the second cleaning roller 32 will be omitted. The first cleaning roller 31 includes a core 31*a*, and an elastic layer 31*b* formed on the outer circumferential surface of the core 31*a*. The material of the core 31*a* may be a metal such as free-cutting steel or stainless steel, or a resin such as polyacetal (POM). The material of the core 31*a* and the surface treatment method for the core 31*a* may be selected as appropriate in accordance with use condition, such as sliding property. The elastic layer 31*b* formed on the core 31*a* may be a single layer, or may be a multilayer having two or more layers. The elastic layer 31*b* may contain foam, or may have two layers of a solid layer and a foam layer.

In the present embodiment, the core 31*a* is a stainless steel (SUS) material whose outer diameter is 6 mm, and on which the rustproofing treatment is performed. The elastic layer 31*b* is made of polyether polyol. Specifically, the elastic layer 31*b* is made of urethane foam sheet containing silicone foam stabilizer (polyether polyurethane, EPM70, made by INOAC CORPORATION). The elastic layer 31*b* is formed such that the outer diameter of the first cleaning roller 31, which includes the elastic layer 31*b*, is 11 mm.

The first cleaning roller 31 may be made as follows: the elastic layer 31*b* is first machined so as to have a predetermined size, then a hole is formed in a sheet of the elastic layer 31*b*, then bonding agent is applied to the hole, then the core 31*a* having an outer diameter of 6 mm is inserted into the hole, then the core 31*a* and the elastic layer 31*b* are heated to bond the elastic layer 31*b* to the core 31*a*, then the core 31*a* and the elastic layer 31*b* are cooled, and then the elastic layer 31*b* is grinded. The first cleaning roller 31 is then soaked in a chlorine bleaching agent (Haiter made by Kao Corporation) for example, and left at 25° C. for 24 hours. Then the first cleaning roller 31 is fully cleaned with ion exchanged water, and completed. Here, the first cleaning roller 31 may be cylindrically formed, as described above, such that sponge is formed on the whole surface of the core 31*a*, or may be formed such that a helical elastic member whose axis is parallel to the center line of rotation of the charging roller is formed on the core 31*a*.

The material of the elastic layer 31*b* is preferably polyether polyol, rather than silicone rubber, fluororubber, and nitrile rubber (NBR). This is because the elastic layer 31*b* made of polyether polyol allows the cleaning roller to clean the charging roller for a long time. For example, the cleaning roller made of polyether polyol is less torn and damaged when images are repeatedly formed. In addition, the cleaning roller made of polyether polyol has toughness against tearing and pulling force, and has less permanent deformation. However, the polyether polyurethane is often made by using silicone foam stabilizer, such as silicone oil. The silicone oil is an oil having an organopolysiloxane structure. Examples of the compound having such a structure include polyoxyalkylene dimethylpolysiloxane copolymer.

Image Defect Caused by Cleaning Roller

When the elastic layer of the cleaning roller is made of polyether polyurethane, the following problem may occur. That is, when the charging roller has not been operated for a long time, the silicone oil contained in the elastic layer of the cleaning roller may contaminate the charging roller, possibly causing an image defect such as uneven density. As countermeasures, the amount of silicone oil of the elastic layer of the cleaning roller could be reduced to prevent the image defect. However, it is difficult to reduce the amount of silicone oil to zero. In addition, the property of the surface of the charging roller changes with time as images are repeatedly formed. The change in property of the surface of the charging roller also makes it difficult to completely prevent the image defect caused by the reaction of a component of the material of the charging roller and a component of the material of the cleaning roller.

Here, the present inventors have found the following fact. That is, the degree of image defect, such as uneven density, caused by the charging roller contaminated in a long period of time in which the charging roller has not been operated, is worst at a time immediately after the non-operation time, and is then improved as images are repeatedly formed. In addition, the degree of image defect deteriorates more as the humidity around the image forming apparatus 1 decreases.

The image defect caused by the contact portion of the charging roller, which has been in contact with the cleaning roller, is worst when an image is formed immediately after the period of time in which the charging roller has not been operated. For example, there is a case in which a user uses the image forming apparatus 1 at an ambient temperature of 30° C. and a humidity of 60%, and in which the user uses the image forming apparatus 1 until 5:00 p.m. on one day and uses the image forming apparatus 1 again from 10:00 a.m. on the next day. Since the image forming apparatus 1 is not used in a period of time from 5:00 p.m. to 10:00 a.m., the period of time is a non-operation time of the image forming apparatus 1. When the image forming apparatus 1 has not been operated from 5:00 p.m. to 10:00 a.m., and is started to operate at 10:00 a.m. to form an image, an image defect will be caused by the reaction between the contact portion of the charging roller and the cleaning roller. The degree of the image defect is worst at a time immediately after the non-operation time, but is improved as images are successively formed after that. This is probably because the rotation of the charging roller causes the state of the contact portion of the charging roller, which is a cause of the image defect, to become closer to the state of the noncontact portion of the charging roller. Through a measurement, it is found that when the charging roller makes about forty revolutions, the image defect becomes inconspicuous.

By the way, for the purpose of speedup, the single photosensitive drum 51 may be provided with the plurality of charging rollers 21 and 22. In this case, if the image defect caused by the first charging roller 21 disposed upstream in the rotational direction R of the photosensitive drum 51 and the image defect caused by the second charging roller 22 disposed downstream in the rotational direction R overlap with each other on the photosensitive drum 51, the image defects will easily become conspicuous.

Arrangement of Charging Roller and Cleaning Roller

Figure 5:
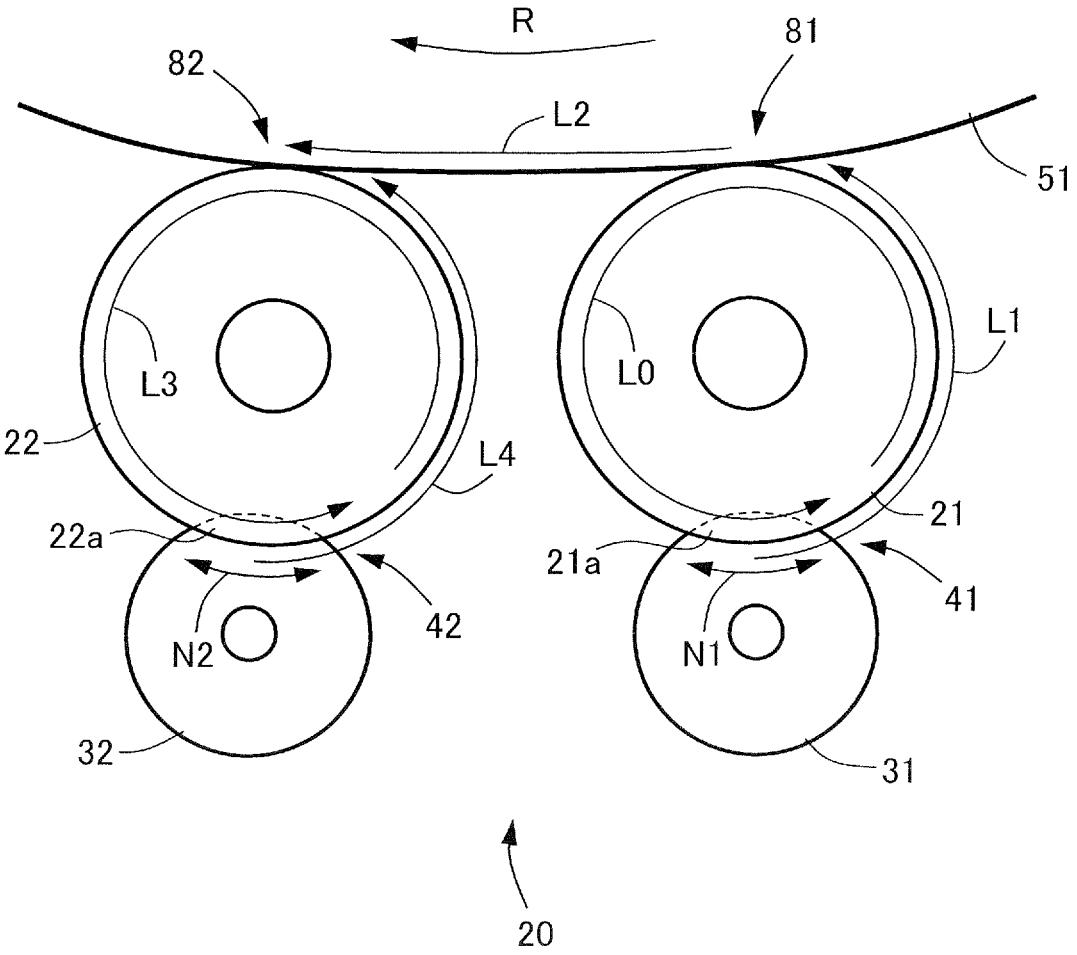
FIG. 5 is a side view schematically illustrating the charging portion of the image forming apparatus of the first embodiment.

In the present embodiment, the charging rollers 21 and 22 disposed upstream and downstream in the rotational direction R are arranged as below to prevent the image defects from overlapping with each other, and from becoming conspicuous. As illustrated in FIG. 5, the photosensitive drum 51 is rotated in the rotational direction R.

The first charging roller 21 is disposed upstream in the rotational direction R of the photosensitive drum 51, and rotates depending on the rotation of the photosensitive drum 51. The first cleaning roller 31 is in contact with the first charging roller 21, and rotates depending on the rotation of the first charging roller 21. Here, a first abutment length of the first contact area 41 between the first charging roller 21 and the first cleaning roller 31 is denoted by a symbol N1. The first abutment length N1 is stably kept at a predetermined length by pressing the first cleaning roller 31 against the first charging roller 21. The first abutment length N1 of the first contact area 41 is a length measured along the circumferential direction of the first charging roller 21, and is about 3 mm in the present embodiment. The outer diameter of the first charging roller 21 is 14 mm, and an outer-circumference length (length of the whole circumference) L0 of the first charging roller 21 is about 44 mm. A distance between the center of the first contact area 41 in the circumferential direction and the center of a contact portion of the first charging roller 21, which is in contact with the photosensitive drum 51, in the circumferential direction is denoted by a symbol L1. That is, the distance L1 is a circumferential length measured between the center of the first contact area 41 in the circumferential direction and the contact portion of the first charging roller 21, which is in contact with the photosensitive drum 51, in the circumferential direction. In the present embodiment, the first cleaning roller 31 is disposed at a position at which the distance L1 becomes about 22 mm.

Similarly, the second charging roller 22 is disposed downstream in the rotational direction R of the photosensitive drum 51, and rotates depending on the rotation of the photosensitive drum 51. The second cleaning roller 32 is in contact with the second charging roller 22, and rotates depending on the rotation of the second charging roller 22. Here, a second abutment length of the second contact area 42 between the second charging roller 22 and the second cleaning roller 32 is denoted by a symbol N2. The second abutment length N2 is stably kept at a predetermined length by pressing the second cleaning roller 32 against the second charging roller 22. The second abutment length N2 of the second contact area 42 is a length measured along the circumferential direction of the second charging roller 22, and is about 3 mm in the present embodiment. The outer diameter of the second charging roller 22 is 14 mm as is in the first charging roller 21, and an outer-circumference length (length of the whole circumference) L3 of the second charging roller 22 is about 44 mm. A distance between the center of the second contact area 42 in the circumferential direction and the center of a contact portion of the second charging roller 22, which is in contact with the photosensitive drum 51, in the circumferential direction is denoted by a symbol L4. That is, the distance L4 is a circumferential length measured between the center of the second contact area 42 in the circumferential direction and the contact portion of the second charging roller 22, which is in contact with the photosensitive drum 51, in the circumferential direction. In the present embodiment, the second cleaning roller 32 is disposed at a position at which the distance L4 becomes about 22 mm.

In addition, a distance between the center of the contact portion of the first charging roller 21, which is in contact with the photosensitive drum 51, in the circumferential direction and the center of the contact portion of the second charging roller 22, which is in contact with the photosensitive drum 51, in the circumferential direction is denoted by a symbol L2. That is, the distance L2 is a circumferential length measured between the contact portion of the first charging roller 21, which is in contact with the photosensitive drum 51, and the contact portion of the second charging roller 22, which is in contact with the photosensitive drum 51. In the present embodiment, the charging rollers 21 and 22 are disposed at positions at which the distance L2 becomes about 18.5 mm.

Here, a portion of the first charging roller 21, that has been positioned at the first contact area 41 for a long time, is a first contact portion 21*a*. When the first contact portion 21*a* reaches and contacts with the photosensitive drum 51 at the first contact position 81, an image defect may occur at the first contact position 81 on the photosensitive drum 51. Similarly, a portion of the second charging roller 22, that has been positioned at the second contact area 42 for a long time, is a second contact portion 22*a*. When the second contact portion 22*a* reaches and contacts with the photosensitive drum 51 at the second contact position 82, an image defect may occur at the second contact position 82 on the photosensitive drum 51. If the contact portions 21*a* and 22*a*, that have been positioned at the contact areas 41 and 42 for a long time, reach and contact with the photosensitive drum 51 at the contact positions 81 and 82, an image defect will become conspicuous at the overlapped portion of each other. Thus, it is desired that the contact portions 21*a* and 22*a* that have been positioned at the contact areas 41 and 42 for a long time do not overlap with each other in reaching and contacting with the photosensitive drum 51.

Thus, the present embodiment allows a peak position of the image defect caused by the first contact portion 21*a*, that is, the center of the first contact portion 21*a* in the circumferential direction, and a peak position of the image defect caused by the second contact portion 22*a*, that is, the center of the second contact portion 22*a* in the circumferential direction to not overlap with each other on the photosensitive drum 51. As described above, it is found that when each of the charging rollers 21 and 22 makes about forty revolutions, the corresponding image defect becomes inconspicuous. Thus, in a period of time in which the charging rollers 21 and 22 make forty revolutions after the non-operation time, the present embodiment allows the peak position of the image defect caused by the center of the first contact portion 21*a* in the circumferential direction and the peak position of the image defect caused by the center of the second contact portion 22*a* in the circumferential direction to not overlap with each other on the photosensitive drum 51. For achieving this, the following equation (1) is required to be satisfied:

$$(X \times L0 + L1 + L2) - (Y \times L3 + L4) \neq 0 \quad (1)$$

where X is an integer in a range of $0 \leq X \leq 40$, and Y is an integer in a range of $0 \leq Y \leq 40$. Here, the equation (1) is required to be satisfied in all combinations of X and Y.

When the equation (1) is satisfied, the peak position of the image defect caused by the first contact portion 21*a* and the peak position of the image defect caused by the second contact portion 22*a* are prevented from overlapping with each other, and thus the image defects can be prevented from becoming conspicuous. Although X is an integer in a range of $0 \leq X \leq 40$ and Y is an integer in a range of $0 \leq Y \leq 40$, the upper limit of X and Y is not limited to 40, and may be selected as appropriate from a range from 30 to 50, for example.

Although the equation (1) allows the peak position of the image defect caused by the first contact portion 21*a* and the peak position of the image defect caused by the second contact portion 22*a* to not overlap with each other, the present disclosure is not limited to this. For example, when the peak position of the image defect caused by the first contact portion 21*a* does not overlap with the image defect caused by the second contact portion 22*a*, or when the peak position of the image defect caused by the second contact portion 22*a* does not overlap with the image defect caused by the first contact portion 21*a*, the image defects can be prevented more effectively from becoming conspicuous. For achieving this, the following equation (2) is required to be satisfied:

$$|(X\times L0+L1+L2)-(Y\times L3+L4)|\geq M1 \quad (2)$$

where M1 is smaller one of N1/2 and N2/2 if N1≠N2, or is N1/2 if N1=N2, X is an integer in a range of 0≤X≤40, and Y is an integer in a range of 0≤Y≤40. Here, the equation (2) is required to be satisfied in all combinations of X and Y.

When the equation (2) is satisfied, the peak position of the image defect caused by the first contact portion 21*a* does not overlap with the image defect caused by the second contact portion 22*a*, or the peak position of the image defect caused by the second contact portion 22*a* does not overlap with the image defect caused by the first contact portion 21*a*, so that the image defects can be prevented more effectively from becoming conspicuous.

Although the equation (2) allows the peak position of the image defect caused by the first contact portion 21*a* to not overlap with the image defect caused by the second contact portion 22*a*, or the peak position of the image defect caused by the second contact portion 22*a* to not overlap with the image defect caused by the first contact portion 21*a*, the present disclosure is not limited to this. For example, when the peak position of the image defect caused by the first contact portion 21*a* does not overlap with the image defect caused by the second contact portion 22*a*, and when the peak position of the image defect caused by the second contact portion 22*a* does not overlap with the image defect caused by the first contact portion 21*a*, the image defects can be prevented more effectively from becoming conspicuous. For achieving this, the following equation (3) is required to be satisfied:

$$|(X\times L0+L1+L2)-(Y\times L3+L4)|\geq M2 \quad (3)$$

where M2 is larger one of N1/2 and N2/2, X is an integer in a range of 0≤X≤40, and Y is an integer in a range of 0≤Y≤40. Here, the equation (3) is required to be satisfied in all combinations of X and Y.

When the equation (3) is satisfied, the peak position of the image defect caused by the first contact portion 21*a* does not overlap with the image defect caused by the second contact portion 22*a*, and the peak position of the image defect caused by the second contact portion 22*a* does not overlap with the image defect caused by the first contact portion 21*a*, so that the image defects can be prevented more effectively from becoming conspicuous.

Although the equation (3) allows the peak position of the image defect caused by the first contact portion 21*a* to not overlap with the image defect caused by the second contact portion 22*a*, and the peak position of the image defect caused by the second contact portion 22*a* to not overlap with the image defect caused by the first contact portion 21*a*, the present disclosure is not limited to this. For example, when the image defect caused by the first contact portion 21*a* and the image defect caused by the second contact portion 22*a* do not overlap with each other, the image defects can be prevented more effectively from becoming conspicuous. For achieving this, the following equation (4) is required to be satisfied:

$$|(X\times L0+L1+L2)-(Y\times L3+L4)|\geq M3 \quad (4)$$

where M3 is (N1+N2)/2, X is an integer in a range of 0≤X≤40, and Y is an integer in a range of 0≤Y≤40. Here, the equation (4) is required to be satisfied in all combinations of X and Y.

When the equation (4) is satisfied, the image defect caused by the first contact portion 21*a* and the image defect caused by the second contact portion 22*a* do not overlap with each other, so that the image defects can be prevented from becoming conspicuous.

Figure 6:
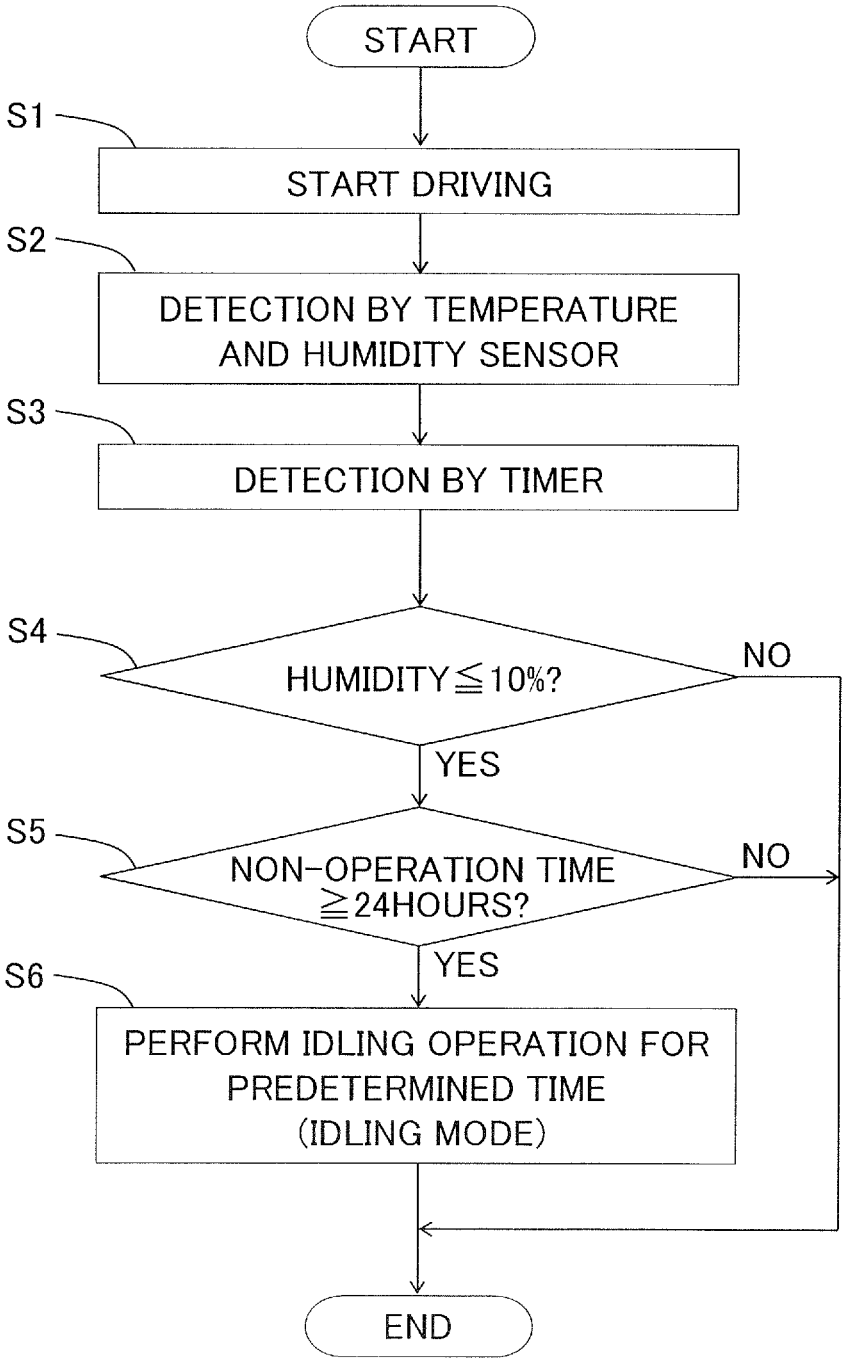
FIG. 6 is a flowchart illustrating procedures of the image forming apparatus of the first embodiment, performed when image formation is started.

Next, procedures performed by the image forming apparatus 1 to start the image formation will be described with reference to a flowchart of FIG. 6. As described above, the degree of image defect, such as uneven density, caused by the charging rollers 21 and 22 contaminated in a long period of time in which the charging rollers 21 and 22 have not been operated is worst at a time immediately after the non-operation time, and is then improved as images are repeatedly formed. In addition, the degree of image defect deteriorates more as the humidity around the image forming apparatus 1 decreases. Thus, the present embodiment uses data from the temperature-and-humidity sensor 14 and the timer 17 connected to the control unit 70, as illustrated in FIG. 2, and performs control as described below.

The control unit 70 detects a state that needs the photosensitive drum 51 to be driven (Step S1). For example, the control unit 70 detects the above-described state when the control unit 70 detects the ON state of the power, a return from a sleep state, or a start signal produced when the image formation is started. The control unit 70 causes the temperature-and-humidity sensor 14 to detect a temperature, a humidity, and the amount of moisture around the image forming apparatus 1 (Step S2). The control unit 70 then causes the timer 17 to detect the non-operation time for which the charging rollers 21 and 22, and the cleaning rollers 31 and 32, have not been operated (Step S3).

The control unit 70 then determines whether the detected humidity is 10% or less (Step S4). If the control unit 70 determines that the detected humidity is 10% or less (Step S4: YES), then the control unit 70 determines whether the non-operation time is 24 hours or more (Step S5). If the control unit 70 determines that the non-operation time is 24 hours or more (Step S5: YES), then the control unit 70 extracts parameters on idling time and idling condition from a database of the control unit 70, and causes the photosensitive drum 51 to run idle in accordance with the parameters from the database (Step S6: idling mode). The idling operation is performed for a predetermined time, such as about one to three minutes. While the idling operation is performed, toner may or may not be supplied. If the control unit 70 determines in Step S4 that the humidity is more than 10%, or determines in Step S5 that the non-operation time is less than 24 hours, then the control unit 70 does not perform the idling operation of Step S6, and continues to perform the startup operation performed when the power is turned on, to form images. In this case, the control unit 70 performs a normal idling operation (for example, for 10 to 30 seconds). That is, the control unit 70 performs the normal idling operation when the power is turned on or when a pre-rotation mode is performed in the start of an image forming job. Also, the control unit 70 performs the idling mode in Step S6, in addition to the normal idling operation (for example, the pre-rotation mode). Then the control unit 70 completes the procedures.

As described above, the control unit 70 performs the idling mode that causes the photosensitive drum 51 to run idle when no images are formed. Specifically, if the time detected by the timer 17 is a first time (which is, for example, less than 24 hours), the control unit 70 performs the idling mode for a first idling time (which is, for example, 10 to 15 seconds). In addition, if the time detected by the timer 17 is a second time (which is, for example, 24 hours or more) longer than the first time, the control unit 70 performs the idling mode for a second idling time (which is, for example, 1 to 3 minutes) longer than the first idling time.

In addition, the control unit 70 performs the idling mode, depending on data detected by the temperature-and-humidity sensor 14. Specifically, if the humidity detected by the temperature-and-humidity sensor 14 is a first humidity (which is, for example, more than 10%), the control unit 70 performs the idling mode for the first idling time (which is, for example, 10 to 15 seconds). In addition, if the humidity detected by the temperature-and-humidity sensor 14 is a second humidity (which is, for example, 10% or less) lower than the first humidity, the control unit 70 performs the idling mode for the second idling time (which is, for example, 1 to 3 minutes) longer than the first idling time.

As described above, the image forming apparatus 1 of the present embodiment allows the peak position of the image defect caused by the first contact portion 21*a* and the peak position of the image defect caused by the second contact portion 22*a* to not overlap with each other on the photosensitive drum 51, in a period of time in which the charging rollers 21 and 22 make forty revolutions after the non-operation time. Thus, even in the configuration in which the plurality of charging rollers 21 and 22 are disposed, the image defect caused by the first charging roller 21 having been in contact with the cleaning roller 31 for a long time and the image defect caused by the second charging roller 22 having been in contact with the cleaning roller 32 for the long time can be prevented from overlapping with each other, so that the image defects can be prevented from becoming conspicuous.

In addition, the image forming apparatus 1 of the present embodiment performs the idling operation in consideration of the degree of uneven density, which will be caused by the contamination of the charging rollers 21 and 22 that have not been operated for a long time, so that the image defects can be prevented from becoming conspicuous. That is, since the image forming apparatus 1 detects the ambient conditions and the non-operation time, and performs the idling operation as appropriate, the image forming apparatus 1 can not only prevent any image defect, but also minimize the reduction in productivity by reducing useless idling operation.

In the above-described image forming apparatus 1 of the present embodiment, both the temperature-and-humidity sensor 14 and the timer 17 are used to determine whether the image forming apparatus 1 will perform the idling mode or not. The present disclosure, however, is not limited to this. For example, one of the temperature-and-humidity sensor 14 and the timer 17 may be used to determine whether the image forming apparatus 1 will perform the idling mode or not.

In addition, although the image forming apparatus 1 of the present embodiment does not use a use history of the charging rollers 21 and 22, the use history may be used. This is because the image defect may vary depending on the surface condition and the resistance of the charging rollers 21 and 22, the surface condition of the cleaning rollers 31 and 32, and how much the charging rollers 21 and 22 are contaminated. Thus, in addition to the use of the temperature-and-humidity sensor 14 and the timer 17, the use history of the charging rollers 21 and 22 and the cleaning rollers 31 and 32 (for example, the number of image-formed sheets determined for each environmental condition) may be stored in the RAM 73 (see FIG. 2), and the use history may be used to determine the execution of the idling mode and adjust the period of time of the idling mode.

Figure 7:
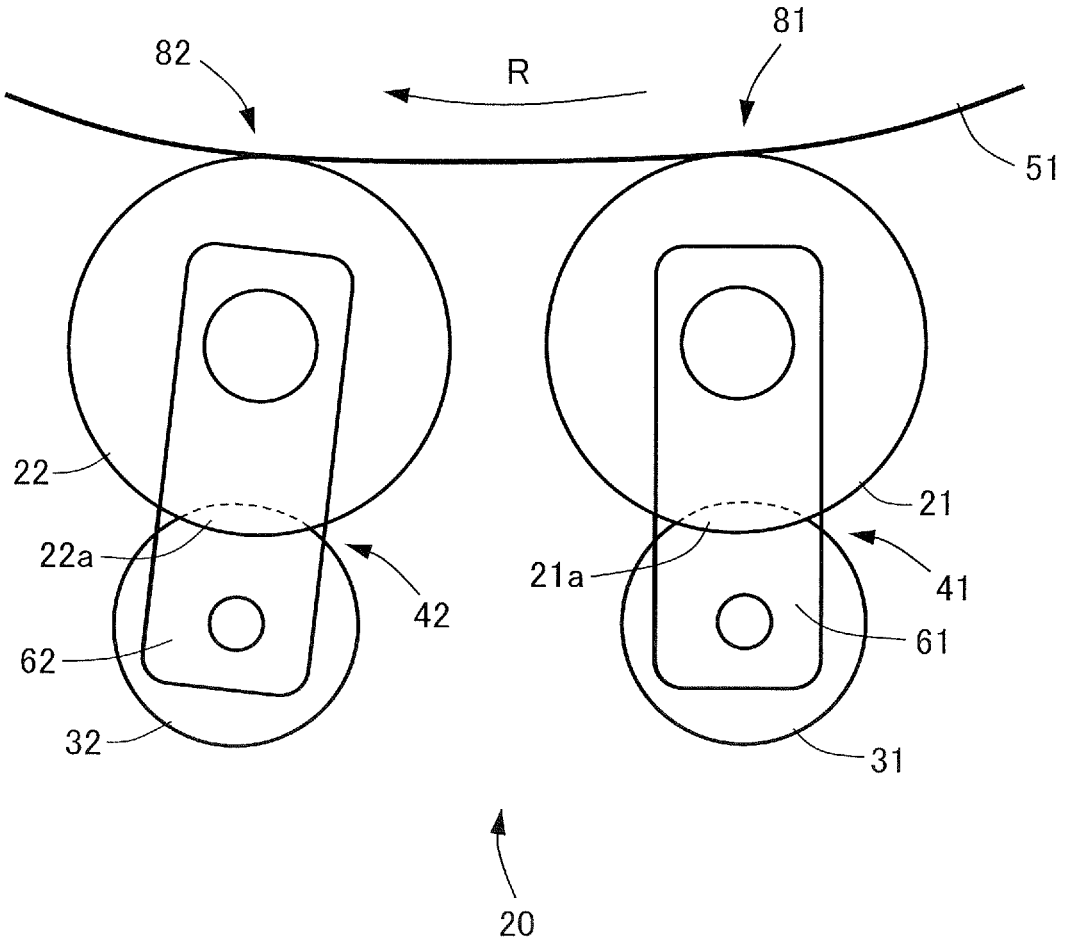
FIG. 7 is a side view schematically illustrating a modification of the charging portion of the image forming apparatus of the first embodiment.

In addition, although the cleaning rollers 31 and 32 are respectively urged toward the charging rollers 21 and 22 by urging springs (not illustrated) in the image forming apparatus 1 of the present embodiment, the present disclosure is not limited to this. For example, as illustrated in FIG. 7, the distance between the axis of the first charging roller 21 and the axis of the first cleaning roller 31 may be fixed by a bearing 61 so that the pressure and the deformation of the first charging roller 21 and the first cleaning roller 31 are set to predetermined values, and the distance between the axis of the second charging roller 22 and the axis of the second cleaning roller 32 may be fixed by a bearing 62 so that the pressure and the deformation of the second charging roller 22 and the second cleaning roller 32 are set to predetermined values. Here, although the bearings 61 and 62 are respectively provided for the charging rollers 21 and 22, the bearings 61 and 62 may be replaced by a single bearing. In addition, the charging rollers 21 and 22 are pressed against the photosensitive drum 51 by springs with a total pressure of 1000 gf. In this case, the value of load applied by the springs is set in consideration of self-weight of the charging rollers 21 and 22 and the cleaning rollers 31 and 32. With the value of load, the difference in circumferential velocity between the photosensitive drum 51 and the charging rollers 21 and 22 can be within 5%.

In addition, in the image forming apparatus 1 of the present embodiment, the cleaning rollers 31 and 32 are respectively used as cleaning members for the charging rollers 21 and 22. However, the present disclosure is not limited to this. For example, cleaning pads that do not rotate may be used.

In addition, in the image forming apparatus 1 of the present embodiment, the control unit 70 determines whether to perform the idling mode, depending on the humidity detected by the temperature-and-humidity sensor 14. However, the present disclosure is not limited to this. For example, the control unit 70 may determine whether to perform the idling mode, depending on the temperature detected by the temperature-and-humidity sensor 14.

Second Embodiment

Next, a second embodiment of the present invention will be described in detail with reference to FIG. 8. The present embodiment differs from the first embodiment in that a single cleaning roller 30 is shared by the two charging rollers 21 and 22. Since other configurations of the second embodiment are the same as those of the first embodiment, components identical to those of the first embodiment are given identical symbols and detailed description thereof will be omitted.

Figure 8:
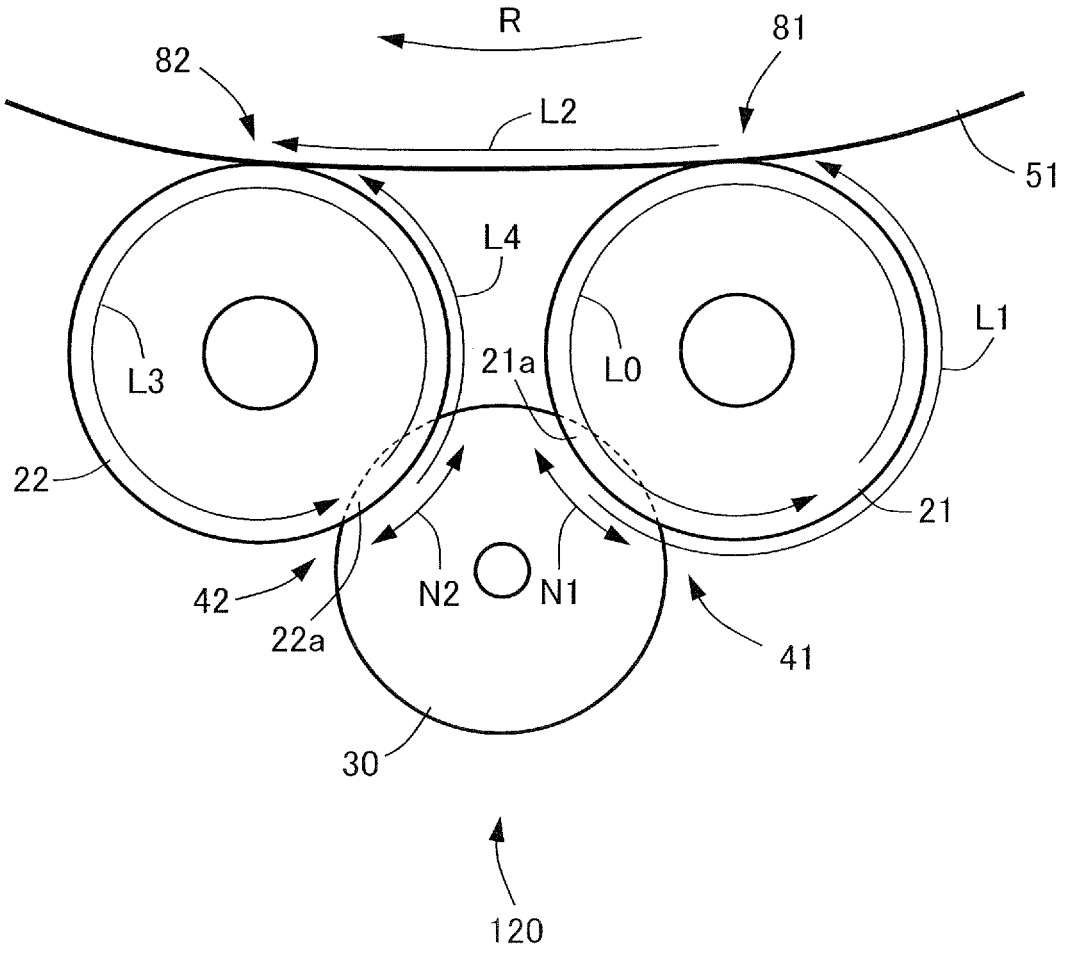
FIG. 8 is a side view schematically illustrating a charging portion of an image forming apparatus of a second embodiment.

In the present embodiment, as illustrated in FIG. 8, a charging portion 120 includes the first charging roller 21, the second charging roller 22, and the cleaning roller (cleaning member) 30 shared by the charging rollers 21 and 22. The cleaning roller 30 is in contact with the charging rollers 21 and 22 and rotates depending on the rotation of the first and the second charging rollers 21 and 22, while cleaning the first and the second charging rollers 21 and 22.

In the present embodiment, the charging rollers 21 and 22 have outer diameters different from those of the first embodiment. That is, the outer diameter of the first charging roller 21 disposed upstream in the rotational direction R of the photosensitive drum 51 is 12 mm, and the outer diameter of the second charging roller 22 disposed downstream in the rotational direction R is 18 mm. The first abutment length N1 of the first contact area 41 of the first charging roller 21, which is in contact with the cleaning roller 30, is about 3 mm. The second abutment length N2 of the second contact area 42 of the second charging roller 22, which is in contact with the cleaning roller 30, is about 4 mm.

The outer diameter of the first charging roller 21 is 12 mm, and the outer-circumference length (length of the whole circumference) L0 of the first charging roller 21 is about 37.7 mm. The distance L1 between the center of the first contact area 41 in the circumferential direction and the center of a contact portion of the first charging roller 21, which is in contact with the photosensitive drum 51, in the circumferential direction is about 25.1 mm. Similarly, the outer diameter of the second charging roller 22 is 18 mm, and the outer-circumference length L3 of the second charging roller 22 is about 56.5 mm. The distance L4 between the center of the second contact area 42 in the circumferential direction and the center of a contact portion of the second charging roller 22, which is in contact with the photosensitive drum 51, in the circumferential direction is about 18.8 mm. In addition, the distance L2 between the center of the contact portion of the first charging roller 21, which is in contact with the photosensitive drum 51, in the circumferential direction and the center of the contact portion of the second charging roller 22, which is in contact with the photosensitive drum 51, in the circumferential direction is about 18.5 mm.

In the present embodiment, when the parameters L0 to L4, N1, and N2 satisfy the equation (1) described in the first embodiment, the peak position of the image defect caused by the first contact portion 21*a* and the peak position of the image defect caused by the second contact portion 22*a* can be prevented from overlapping with each other. In this manner, the image defects can be prevented from becoming conspicuous. Similarly, when each of the equations (2) to (4) is satisfied, the image defects can also be prevented more effectively from becoming conspicuous.

Third Embodiment

Next, a third embodiment of the present invention will be described in detail with reference to FIG. 9. The present embodiment differs from the first embodiment in that three charging rollers 21, 22, and 23 are used for the single photosensitive drum 51. Since other configurations of the third embodiment are the same as those of the first embodiment, components identical to those of the first embodiment are given identical symbols and detailed description thereof will be omitted.

Figure 9:
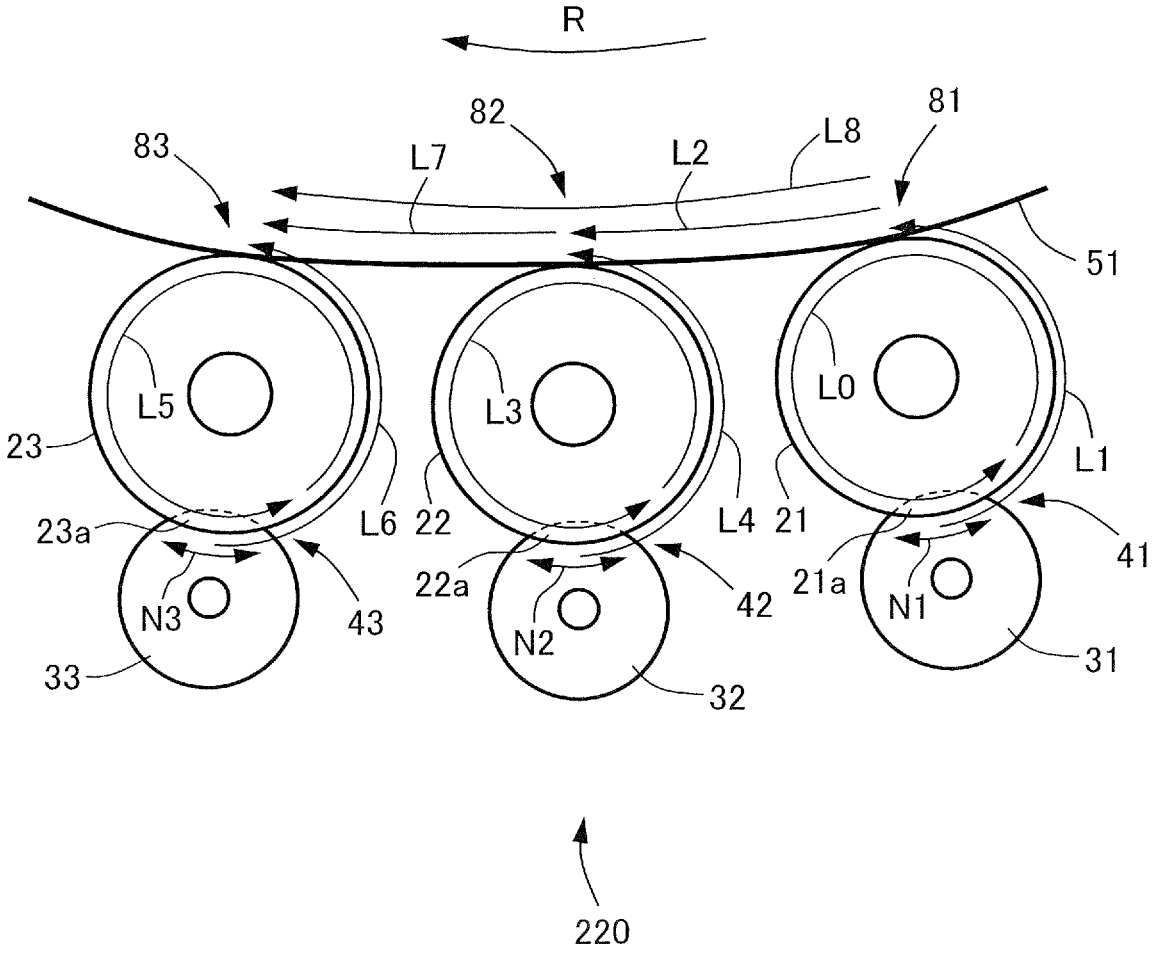
FIG. 9 is a side view schematically illustrating a charging portion of an image forming apparatus of a third embodiment.

In the present embodiment, as illustrated in FIG. 9, a charging portion 220 includes the first charging roller 21, the second charging roller 22, and a third charging roller 23. The third charging roller 23 is configured to be rotated by being in contact with the photosensitive drum 51 and charge the photosensitive drum 51 when a charging bias is applied. The third charging roller 23 is in contact with the photosensitive drum 51 at a third contact position 83 positioned downstream, in the rotational direction R of the photosensitive drum 51, from the second contact position 82 at which the second charging roller 22 is in contact with the photosensitive drum 51. The charging portion 220 further includes the first cleaning roller 31 that is in contact with the first charging roller 21 and cleans the first charging roller 21, the second cleaning roller 32 that is in contact with the second charging roller 22 and cleans the second charging roller 22, and a third cleaning roller 33, serving as a third cleaning member, that is in contact with the third charging roller 23 and cleans the third charging roller 23. The third cleaning roller 33 is in contact with the third charging roller 23 at a third contact area 43 and configured to clean a surface of the third charging roller23.

In the present embodiment, L5 represents a length of a whole circumference of the third charging roller 23. L6 represents a length in a circumferential direction of the third charging roller 23 between a center position of the third contact area 43 in the circumferential direction and the third contact position 83 of the third charging roller 23 and the photosensitive drum 51. L7 represents a length in the rotational direction R of the photosensitive drum 51 between the second contact position 82 and the third contact position 83. L8 represents a length in the rotational direction R of the photosensitive drum 51 between the first contact position 81 and the third contact position 83.

When any two of the three charging rollers 21, 22, and 23 and corresponding cleaning rollers are arranged so as to satisfy the equation (1), the peak position of the image defect caused by one contact portion and the peak position of the image defect caused by the other contact portion can be prevented from overlapping with each other. For achieving this, the following equations (5) and (6) are required to be satisfied:

$$(X\times L0+L1+L8)-(Y\times L5+L6)\neq 0 \quad (5)$$

$$(X\times L3+L4+L7)-(Y\times L5+L6)\neq 0 \quad (6)$$

where X is an integer in a range of $0\leq X\leq 40$, and Y is an integer in a range of $0\leq Y\leq 40$. Here, the equation (5) and (6) are required to be satisfied in all combinations of X and Y. Thus, the image defects can be prevented from becoming conspicuous. Similarly, when each of the equations (2) to (4) is satisfied, the image defects can also be prevented more effectively from becoming conspicuous.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-154294, filed Aug. 20, 2018, which is hereby incorporated by reference herein in its entirety.

What is claimed is:

1. An image forming apparatus comprising:

a photosensitive member configured to move while bearing an electrostatic latent image;

a first charging roller configured to be rotated by being in contact with the photosensitive member and charge the photosensitive member when a charging bias is applied;

a first cleaning member in contact with the first charging roller at a first contact area and configured to clean a surface of the first charging roller;

a second charging roller configured to be rotated by being in contact with the photosensitive member and charge the photosensitive member when a charging bias is applied, the second charging roller being in contact with the photosensitive member at a second contact position positioned downstream, in a moving direction of the photosensitive member, from a first contact position at which the first charging roller is in contact with the photosensitive member; and a second cleaning member in contact with the second charging roller at a second contact area and configured to clean a surface of the second charging roller, wherein the following first relationship is satisfied:

$$(X\times L0+L1+L2)-(Y\times L3+L4)\neq 0,$$

where L0 represents a length of a whole circumference of the first charging roller, L1 represents a length in a circumferential direction of the first charging roller between a center position of the first contact area in the circumferential direction and the first contact position of the first charging roller and the photosensitive member, L3 represents a length of a whole circumference of the second charging roller, L4 represents a length in a circumferential direction of the second charging roller between a center position of the second contact area in the circumferential direction and the second contact position of the second charging roller and the photosensitive member, L2 represents a length in the moving direction of the photosensitive member between the first contact position and the second contact position, X represents an integer in a range of $0 \leq X \leq 40$, and Y represents an integer in a range of $0 \leq Y \leq 40$, and wherein the first relationship is satisfied in all combinations of X and Y.

2. The image forming apparatus according to claim 1, further comprising:

a third charging roller configured to be rotated by being in contact with the photosensitive member and charge the photosensitive member when a charging bias is applied, the third charging roller being in contact with the photosensitive member at a third contact position positioned downstream, in the moving direction of the photosensitive member, from the second contact position at which the second charging roller is in contact with the photosensitive member; and a third cleaning member in contact with the third charging roller at a third contact area and configured to clean a surface of the third charging roller, wherein the following second relationship is satisfied:

$$(X \times L0 + L1 + L8) - (Y \times L5 + L6) \neq 0$$

$$(X \times L3 + L4 + L7) - (Y \times L5 + L6) \neq 0,$$

where L5 represents a length of a whole circumference of the third charging roller, L6 represents a length in a circumferential direction of the third charging roller between a center position of the third contact area in the circumferential direction and the third contact position of the third charging roller and the photosensitive member, L7 represents a length in the moving direction of the photosensitive member between the second contact position and the third contact position, L8 represents a length in the moving direction of the photosensitive member between the first contact position and the third contact position, and wherein the second relationship is satisfied in all combinations of X and Y.

3. The image forming apparatus according to claim 1, wherein the following second relationship is satisfied:

$$|(X \times L0 + L1 + L2) - (Y \times L3 + L4)| \geq M1$$

where N1 represents a length of the first contact area in the circumferential direction of the first charging roller, N2 represents a length of the second contact area in the circumferential direction of the second charging roller, and M1 represents lesser one of N1/2 and N2/2 if $N1 \neq N2$, or represents N1/2 if $N1 = N2$, and wherein the second relationship is satisfied in all combinations of X and Y.

4. The image forming apparatus according to claim 1, wherein the following second relationship is satisfied:

$$|(X \times L0 + L1 + L2) - (Y \times L3 + L4)| \geq M2,$$

where N1 represents a length of the first contact area in the circumferential direction of the first charging roller, N2 represents a length of the second contact area in the circumferential direction of the second charging roller, and M2 represents greater one of N1/2 and N2/2, and wherein the second relationship is satisfied in all combinations of X and Y.

5. The image forming apparatus according to claim 1, wherein the following second relationship is satisfied:

$$|(X \times L0 + L1 + L2) - (Y \times L3 + L4)| \geq M3,$$

where N1 represents a length of the first contact area in the circumferential direction of the first charging roller, N2 represents a length of the second contact area in the circumferential direction of the second charging roller, and M3 represents (N1+N2)/2, and wherein the second relationship is satisfied in all combinations of X and Y.

6. The image forming apparatus according to claim 1, further comprising:

a driving source configured to rotate the photosensitive member; and a control unit configured to control the driving source and perform an idling mode in which the control unit causes the photosensitive member to run idle in a case in which no image is formed.

7. The image forming apparatus according to claim 6, further comprising a time detection unit configured to detect a time for which the first charging roller and the second charging roller have been in a stop state, wherein the control unit is configured to perform the idling mode for a first idling time if a time detected by the time detection unit is a first time, and perform the idling mode for a second idling time longer than the first idling time if a time detected by the time detection unit is a second time longer than the first time.

8. The image forming apparatus according to claim 6, further comprising an environment detection unit configured to detect information on an internal environment of the image forming apparatus, wherein the control unit is configured to perform the idling mode in accordance with the information detected by the environment detection unit.

9. The image forming apparatus according to claim 8, wherein the information is data on humidity, and wherein the control unit is configured to perform the idling mode for a first idling time if a humidity detected by the environment detection unit is a first humidity, and perform the idling mode for a second idling time longer than the first idling time if a humidity detected by the environment detection unit is a second humidity lower than the first humidity.

10. The image forming apparatus according to claim 6, wherein the control unit is configured to perform the idling mode in a case in which a power source of the image forming apparatus is turned on or in a case in which pre-rotation is performed in start of an image forming job.

11. An image forming apparatus comprising:

a photosensitive member configured to move while bearing an electrostatic latent image;

a first charging roller configured to be rotated by being in contact with the photosensitive member and charge the photosensitive member when a charging bias is applied;

a second charging roller configured to be rotated by being in contact with the photosensitive member and charge the photosensitive member when a charging bias is applied, the second charging roller being in contact with the photosensitive member at a second contact position positioned downstream, in a moving direction of the photosensitive member, from a first contact position at which the first charging roller is in contact with the photosensitive member; and a cleaning member in contact with the first charging roller at a first contact area, in contact with the second charging roller at a second contact area, and configured to clean a surface of the first and second charging rollers, wherein the following relationship is satisfied:

$$(X \times L0 + L1 + L2) - (Y \times L3 + L4) \neq 0,$$

where L0 represents a length of a whole circumference of the first charging roller, L1 represents a length in a circumferential direction of the first charging roller between a center position of the first contact area in the circumferential direction and the first contact position of the first charging roller and the photosensitive member, L3 represents a length of a whole circumference of the second charging roller, L4 represents a length in a circumferential direction of the second charging roller between a center position of the second contact area in the circumferential direction and the second contact position of the second charging roller and the photosensitive member, L2 represents a length in the moving direction of the photosensitive member between the first contact position and the second contact position, X represents an integer in a range of $0 \leq X \leq 40$, and Y represents an integer in a range of $0 \leq Y \leq 40$, and wherein the relationship is satisfied in all combinations of X and Y.

* * * * *